US007658573B2

(12) United States Patent
Thompson

(10) Patent No.: US 7,658,573 B2
(45) Date of Patent: Feb. 9, 2010

(54) TRENCH SHORING EXTRACTION DEVICE

(75) Inventor: Alan D. Thompson, Naugatauck, CT (US)

(73) Assignee: John J. Brennan Construction Co., Inc, Shelton, CT (US)

( * ) Notice: Subject to any disclaimer, the term of this patent is extended or adjusted under 35 U.S.C. 154(b) by 77 days.

(21) Appl. No.: 11/868,186

(22) Filed: Oct. 5, 2007

(65) Prior Publication Data

US 2008/0219777 A1 Sep. 11, 2008

Related U.S. Application Data

(60) Provisional application No. 60/894,058, filed on Mar. 9, 2007.

(51) Int. Cl.
*E02D 17/00* (2006.01)

(52) U.S. Cl. ..... 405/282; 405/272; 254/93 R

(58) Field of Classification Search ..... 405/3, 405/154.1, 272, 282, 283; 254/84, 93 R, 254/264; 187/272
See application file for complete search history.

(56) References Cited

U.S. PATENT DOCUMENTS

| | | | | |
|---|---|---|---|---|
| 3,828,864 | A | 8/1974 | Haverkamp et al. | |
| 4,002,035 | A | 1/1977 | Wright | 61/41 |
| 4,218,044 | A | 8/1980 | Ikhsanov et al. | 254/93 |
| 4,487,530 | A | 12/1984 | Morrice | |
| 4,874,271 | A | 10/1989 | Arnold | 405/283 |
| 5,205,673 | A | 4/1993 | Bolin et al. | |
| 5,735,642 | A * | 4/1998 | Barringer | 405/282 |
| 5,931,608 | A | 8/1999 | Wilkinson | 405/283 |
| 6,076,855 | A | 6/2000 | Webb | |
| 6,354,769 | B1 | 3/2002 | Allen | |
| 6,457,904 | B2 | 10/2002 | Bishop et al. | |
| 7,402,003 | B2 * | 7/2008 | Kundel, Sr. | 405/283 |
| 2003/0156904 | A1 | 8/2003 | Kline | 405/154.1 |
| 2004/0247398 | A1 | 12/2004 | Lane et al. | 405/283 |

OTHER PUBLICATIONS

International Search Report and Written Opinion of the International Searching Authority, May 16, 2008 (8).

* cited by examiner

*Primary Examiner*—Frederick L Lagman
(74) *Attorney, Agent, or Firm*—St. Onge Steward Johnston & Reens LLC

(57) ABSTRACT

A hydraulic lifting device including a main beam, two or more connection plates fixedly connected to the main beam, at least two legs, each leg pivotably attached to two of the plates, at least two hydraulic cylinders, each cylinder disposed between the beam and one of the legs, and two or more load connectors.

25 Claims, 11 Drawing Sheets

TRENCH SHORING EXTRACTION DEVICE

CROSS-REFERENCE TO RELATED APPLICATIONS

This application claims priority under 35 U.S.C. §119(e) to the filing date of the U.S. Provisional Application No. 60/894,058, filed on Mar. 9, 2007.

FIELD OF THE INVENTION

The invention relates to a hydraulic lifting device, and more specifically to a hydraulic lifting device and system for extracting shoring materials from an in ground trench.

BACKGROUND OF THE INVENTION

Trench shoring is a process of bracing the walls of a trench in order to prevent collapse. This process is often necessary in the construction field when excavating trenches to lay water and sewer pipes, foundations, cables or underground structures.

Typically the side walls of the trench are lined with one or more boxes or vertical shoring panels. A series of boxes or panels may be successively connected to create a continuous shoring wall on either side of the trench. Several horizontal shoring devices or spreaders may be installed between opposing panels to support the shoring panels along the length of the trench. The term "trench shoring" may also be used to refer to these materials used in the trench shoring process.

After an excavation job is complete or an in ground structure installed, the trench shoring generally must be removed. Given the significant load upon the trench shoring from the adjacent earth, particularly during or after backfilling, removal of the trench shoring can be difficult and dangerous. This is often done by lifting the trench shoring with an excavator vehicle. However, the application of an even and distributed force to the trench shoring is difficult to achieve using an excavator alone. The process is time consuming, difficult and can in some circumstances result in damage to the trench shoring or in ground structure. Furthermore, significant wear is put on the excavator when removing trench shoring.

What is desired therefore is a safe and effective system and device for removing trench shoring. What is also desired is a system and device adaptable for numerous types of vertical lifting applications.

SUMMARY OF THE INVENTION

Accordingly, it is an object of the present invention to provide a system and device for removing trench shoring.

It is a further object of the present invention to provide a system and hydraulic lifting device capable of applying an even vertical load to extract a shoring device or any other subterranean object.

It is a further object of the present invention to provide such a device that is readily portable to and from the excavation site with minimum set up time required.

These and other objects of the present invention are achieved by the provision of a hydraulic lifting device including a main beam, two or more connection plates fixedly connected to the main beam, at least two legs, each leg pivotably attached to two of the plates, at least two hydraulic cylinders, each cylinder disposed between the beam and one of the legs, and two or more load connectors. The hydraulic cylinders are extendable to raise the main beam. In some embodiments, the legs are extendable from a first length to a second length and the device further includes two or more other hydraulic cylinders for extending the legs.

Other objects of the present invention are achieved by provision of a device for trench shoring extraction including a main beam, at least two legs pivotably connectable to the beam, wherein each of the legs having a ground pad at its distal end, at least two hydraulic cylinders, wherein each cylinder disposed between the beam and one of the at least two legs, two or more load connectors mounted to the beam, and wherein the at least two cylinders operate to pivot the at least two legs.

Further provided is a method for extracting trench shoring, including the step of providing a hydraulic lifting device comprising a main beam, at least two legs pivotably connectable to the beam wherein each of the legs includes a ground pad at its distal end, at least two hydraulic cylinders, each cylinder disposed between the main beam and one of the at least two legs and wherein the cylinders operate to pivot the at least two legs, and one or more slings connectable to the main beam. The method further includes the steps of extending at least one of the legs until the ground pads span a trench, lowering the hydraulic lifting device over an opening of the trench until the hydraulic lifting device is at least partially supported over the trench by the ground pads, connecting the one or more slings about at least one trench shoring element, and actuating the hydraulic cylinders in a first direction to lift the trench shoring element a first distance.

In some embodiments, the method also includes actuating the hydraulic cylinders in a second direction to raise the at least two legs, positioning at least one spacer under each ground pad, and actuating the hydraulic cylinders in the first direction to lift the trench shoring element a second distance. The method may further include providing a second one of the hydraulic lifting devices, and connecting one or more slings of the second device about a second portion of the trench shoring element.

Other objects, features and advantages according to the present invention will become apparent from the following detailed description of certain advantageous embodiments when read in conjunction with the accompanying drawings in which the same components are identified by the same reference numerals.

DETAILED DESCRIPTION OF THE INVENTION

Figure 1:
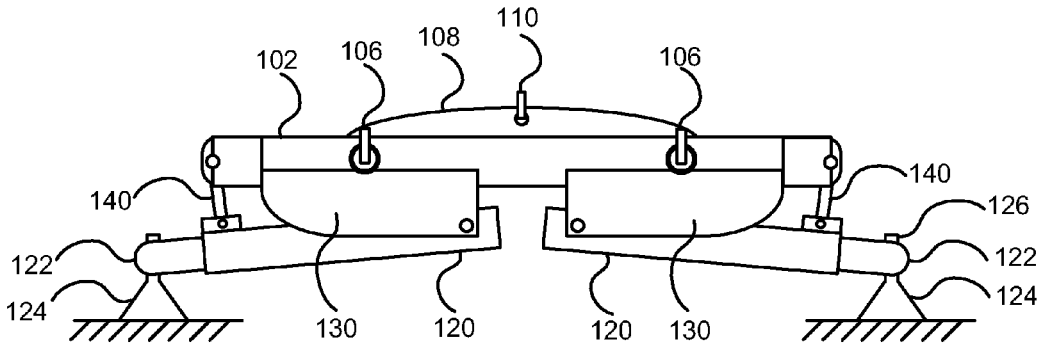
FIG. 1 is front view of a device according to an exemplary embodiment of the present invention.

FIGS. 1-5 illustrate a device according to an exemplary embodiment of the present invention. The device may be useful in a wide variety of vertical lifting applications, and particularly for lifting objects from an in ground or subterranean trench. For example, the device may be used for the extraction of trench shoring.

The device of the present invention includes a beam 102. The beam 102 of the present exemplary embodiment has a 300 ton maximum capacity. In the exemplary embodiment, the beam is a fixed length beam. However, the beam 102 may also be extendable to accommodate a variety of trench widths. For example, the beam 102 may include one or more extension portions, e.g., in the middle of the beam (not shown).

The beam 102 includes two or more load connectors 106. In the exemplary embodiment, each load connector 106 is fixed to the beam 102 and includes two or more pulling lugs for receiving slings 180 (shown in FIGS. 6-8) or any other load attachment means. The beam 102 further includes a backbone portion 108 and at least one support connection 110, e.g., positioned between the load connectors 106. The support connection 110 is preferably adaptable for suspending the device from a machine, such as an excavator or crane, during use and/or transport.

Figure 5:
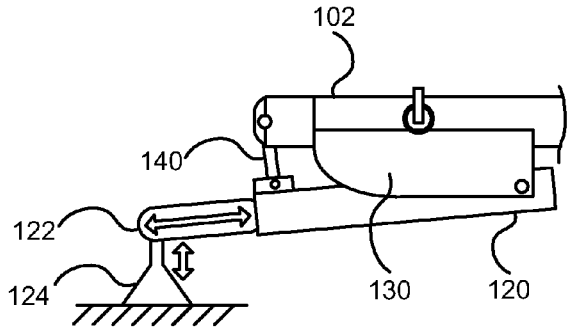
FIG. 5 is another front view of the device shown in FIG. 1.

Shown in FIG. 1, the device of the exemplary embodiment includes at least two legs 120 (e.g., outriggers). Each of the legs 120 is pivotably connected to the beam 102 via side and/or connection plates 130. As shown in FIG. 5, each of the legs 120 may also be extendable in length, e.g., by means of a telescoping or extension portion 122. The extension portions 122 may be hydraulically extendable, e.g., via hydraulic extension cylinders (not shown). In the exemplary embodiment, the extension portions 122 provide for device lengths between about eighteen feet and twenty seven feet. This range is however only exemplary and it should be understood that the device may be scaled for use in significantly smaller or significantly larger applications. Each of the legs 120 further includes a ground pad 124 or outrigger pad. The ground pad 124 may also include an adjustable jack screw 126 for adjusting the position of the ground pad 124 (see, e.g., FIG. 5).

Between each of the legs 120 and the beam 102, the device includes cylinders 140 (e.g., hydraulic cylinders). Each cylinder 140 is pivotable at either or both of its connection to the beam 102 and a leg 120. For example, each cylinder 140 may attach to a distal end of the beam 102 and to the leg 120 at a position between its attachment to the plate 130 and ground pad 124. As described in more detail below, the cylinders 140 provide a load or force between the beam 102 and each of the legs 120 to raise and lower the beam, e.g., while maintaining the beam 102 in a substantially horizontal orientation. The cylinders 140 are preferably hydraulic cylinders actuated by hydraulic fluid pressure. However, the cylinders 140 may be any other cylinder or device for providing such a load or lifting force.

Figure 2:
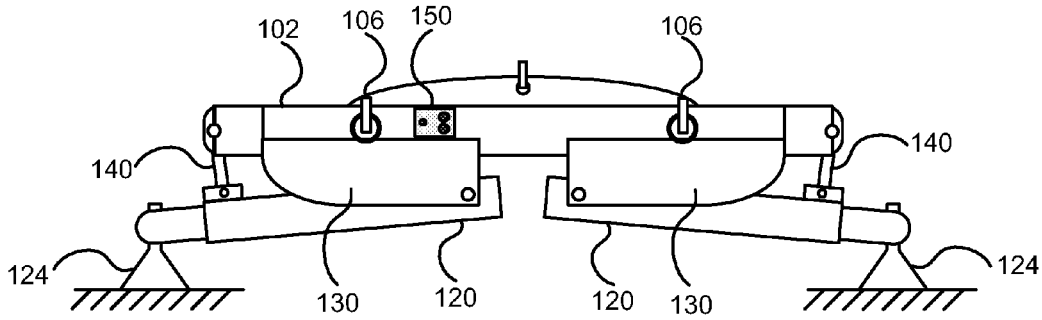
FIG. 2 is rear view of the device shown in FIG. 1.
Figure 3:
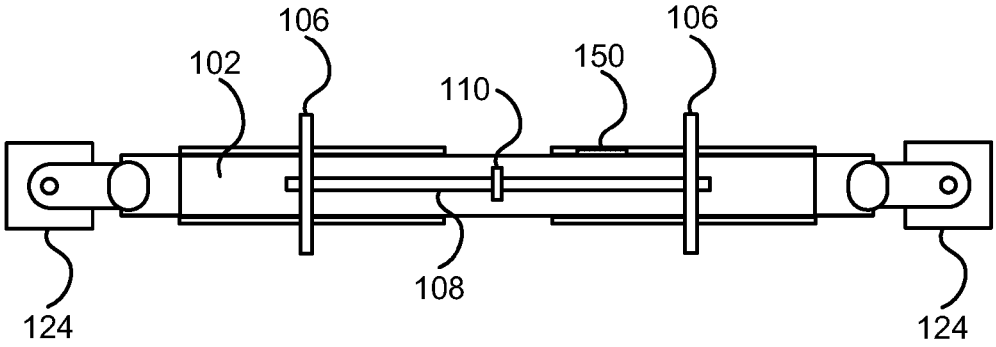
FIG. 3 is top view of the device shown in FIG. 1.
Figure 4:
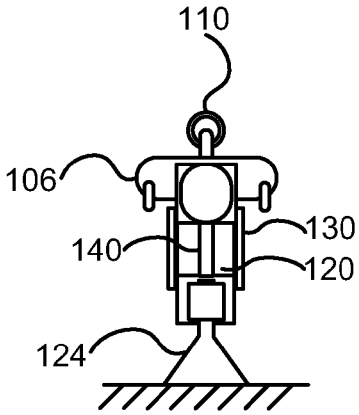
FIG. 4 is side view of the device shown in FIG. 1.

As shown in FIG. 2, the device further includes a control panel 150. The control panel 150 includes a control connection for a control unit for operating the cylinders 140 and, in some embodiments, the extension portions of the beam 102 and/or legs 120. The control panel 150 further includes one or more hydraulic connections for receiving and returning hydraulic fluid for the cylinders 140. The exemplary device further includes one or more valves, such as solenoid valves, in communication with the control panel 150 for controlling hydraulic fluid flow to and from the cylinders 140. The device may also include a pressure test port for monitoring system pressure and one or more pressure relief valves.

Figure 6:
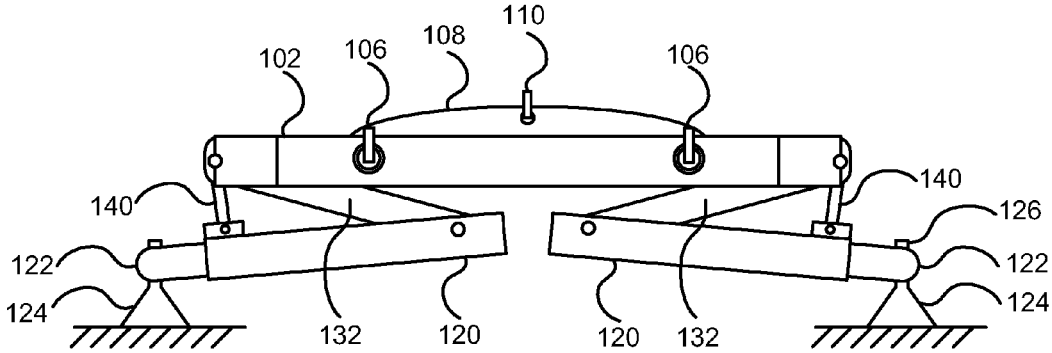
FIG. 6 is front view of a device according to an exemplary embodiment of the present invention.

FIG. 6 illustrates another exemplary embodiment of the present invention. As shown, the device may optionally include two intermediate links 132. The links 132 are pivotably connected on one end to the beam 102 and on the other end to a leg 120.

Figure 7:
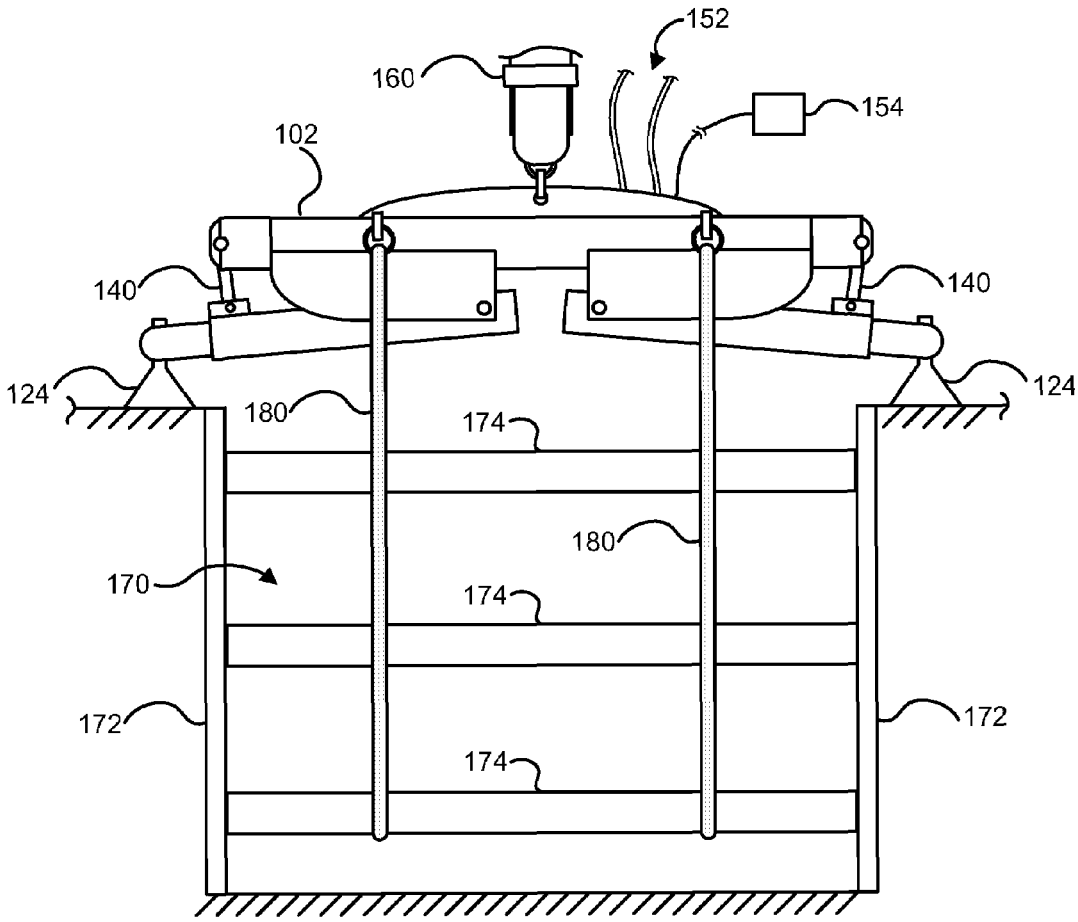
FIG. 7 is front view of a device according to an exemplary embodiment of the present invention in operation.
Figure 8:
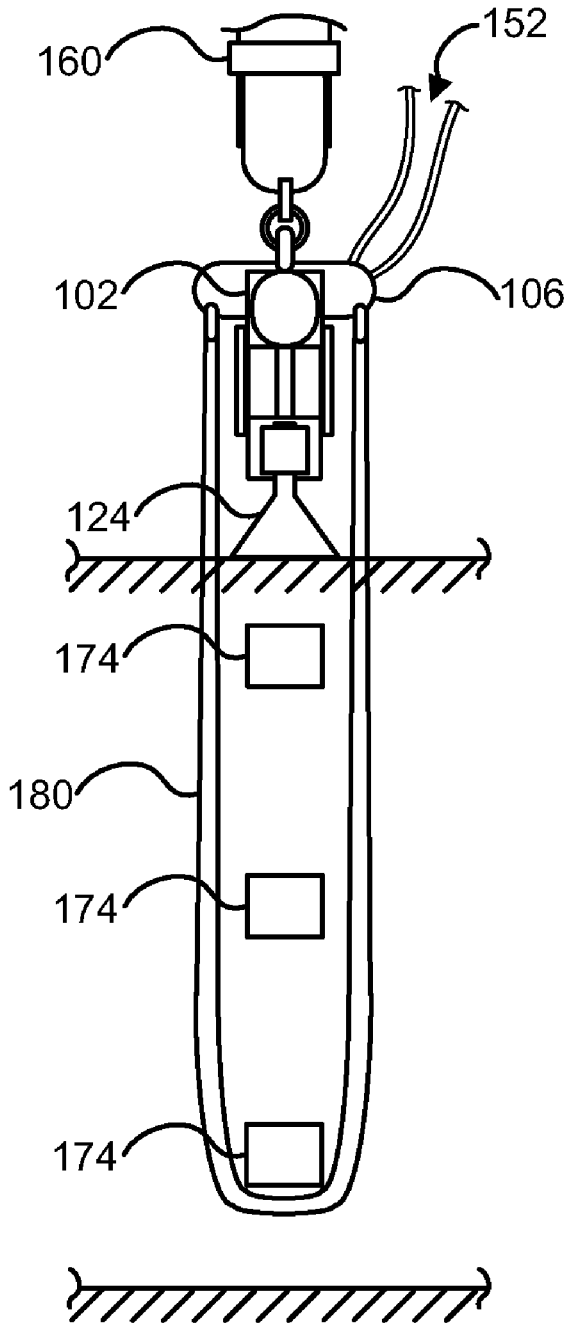
FIG. 8 is side view of the device shown in FIG. 7.

FIGS. 7 and 8 illustrate a device according to an exemplary embodiment of the present invention in operation in a trench shoring application. The device is connectable to an excavator 160 (e.g., hydraulic excavator) or other suspension machine or device via the suspension connector 110. By means of the excavator 160, the device is readily positionable over a trench (e.g., 170). The excavator 160 or other suspension means may also retain and/or stabilize the device during use. As shown, one or more hydraulic lines 152 supply fluid to and return fluid from the cylinders 140 via the control panel 150. In some embodiments, the hydraulic lines 152 receive the hydraulic fluid from the excavator 160 or an auxiliary port thereof. The device also includes a control unit 154 for controlling and/or actuating the cylinders 140 via a wired or wireless connection to the control panel 150. In the exemplary embodiment, the control unit 154 is compatible with 12 or 24 volt power.

The device according to present invention may be positioned and used over an in ground trench 170. In the present example, the trench 170 includes at least one shoring box including spreaders 174 removably or fixedly disposed between walls 172. Prior to or during positioning, at least one of the legs 120 and/or beam 102 may be extended to accommodate the particular trench width or to compensate for above ground obstructions (see, e.g., FIG. 5). In some embodiments the legs 120 and/or beam 102 are hydraulically extendable (e.g., via the control unit 154). The ground pads 124 of the device may, if necessary, be positioned on bearing plates (not shown) about the trench 170.

Figure 9:
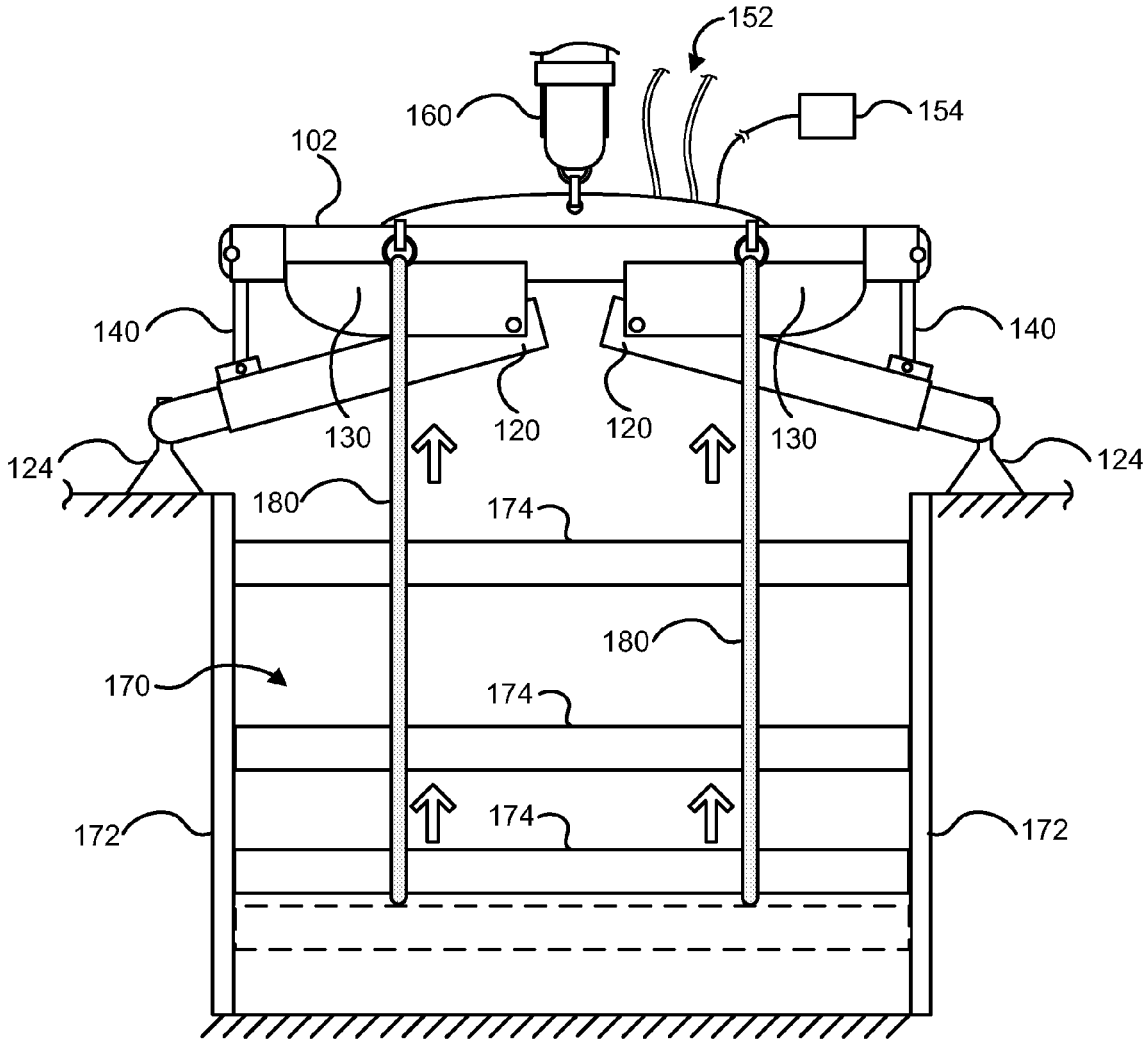
FIG. 9 is another front view of the device shown in FIG. 7.

Depending on the particular type of trench shoring, the present invention may be used to remove particular spreaders 174 (as shown in FIG. 9), walls 172, an entire trench shoring box (as shown in FIGS. 10A-10E) or any other object. The device according to the present invention is connectable to two or more slings 180 (e.g., continuous slings). In the exemplary embodiment, each of the slings 180 has a 180,000 lb. capacity (360,000 lb. combined).

As shown in FIG. 9, the slings 180 may be disposed about one or more of the spreaders 174 and connected to the load connectors 106 of the device. The cylinders 140 may then be actuated (e.g., via the control unit 154) to raise the beam 102 and, in turn, dislodge and/or extract the spreader 174. The cylinders 140 may be actuated simultaneously and/or sequentially as necessary to remove the spreader 174 in a safe and effective manner. Additional spreaders 174 and/or panels 172 may then be removed in a likewise manner.

FIGS. 10A-10E further illustrate a use of the device in removing a trench shoring box (e.g., 172/174). A trenching shoring box may be removed using one of the devices according to the present invention, or multiple devices (e.g., on each end of the box). In some other applications, a device according to the present invention is used on one end of the trenching shoring, and an excavator or crane on another end. Two or more slings 180 are disposed around a portion of the box such as a spreader 174. The cylinders 140 are then actuated in a first direction to raise the beam 102 and, in turn, raise the box vertically.

Figure 10A:
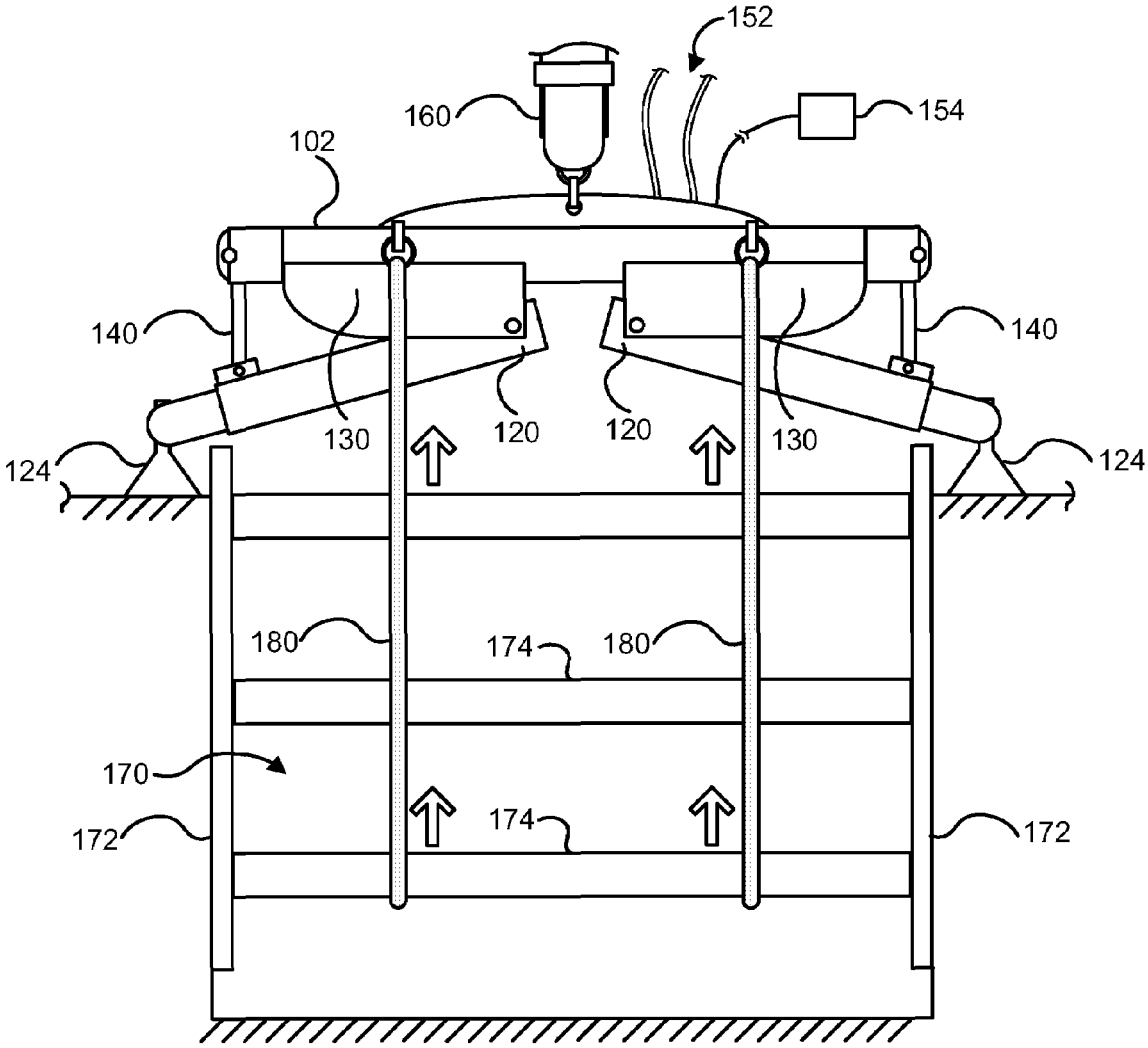
FIGS. 10A-10E are additional front views of the device of FIG. 7 in operation.
Figure 10B:
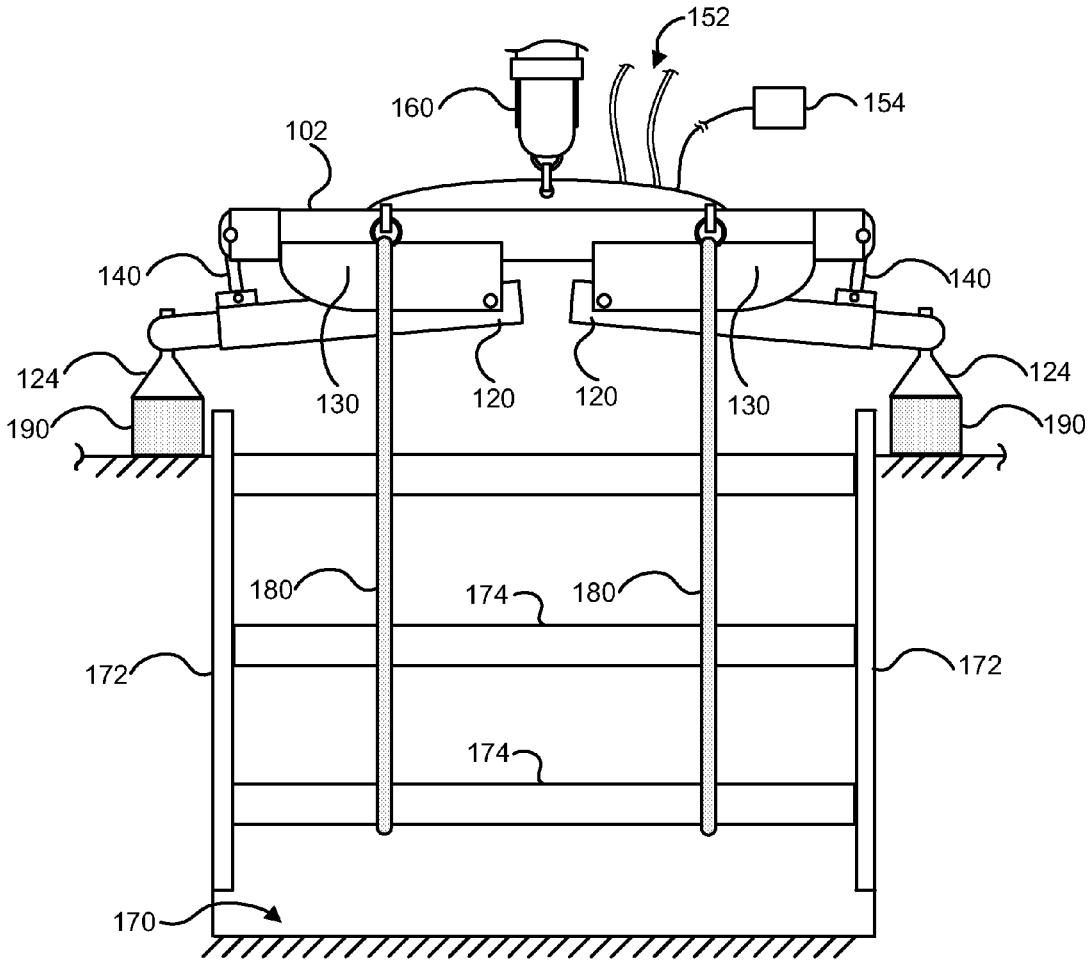
Figure 10C:
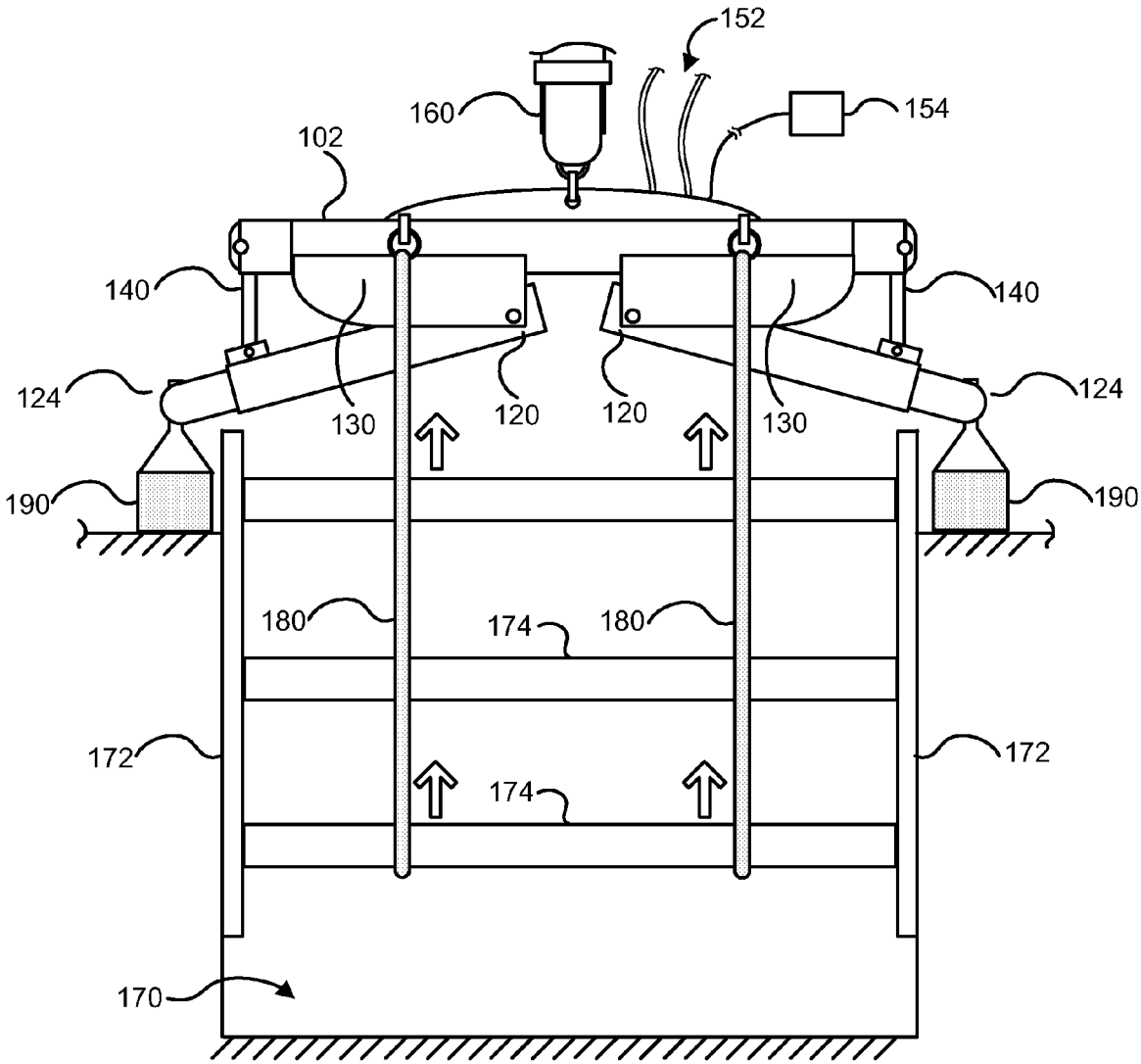
Figure 10D:
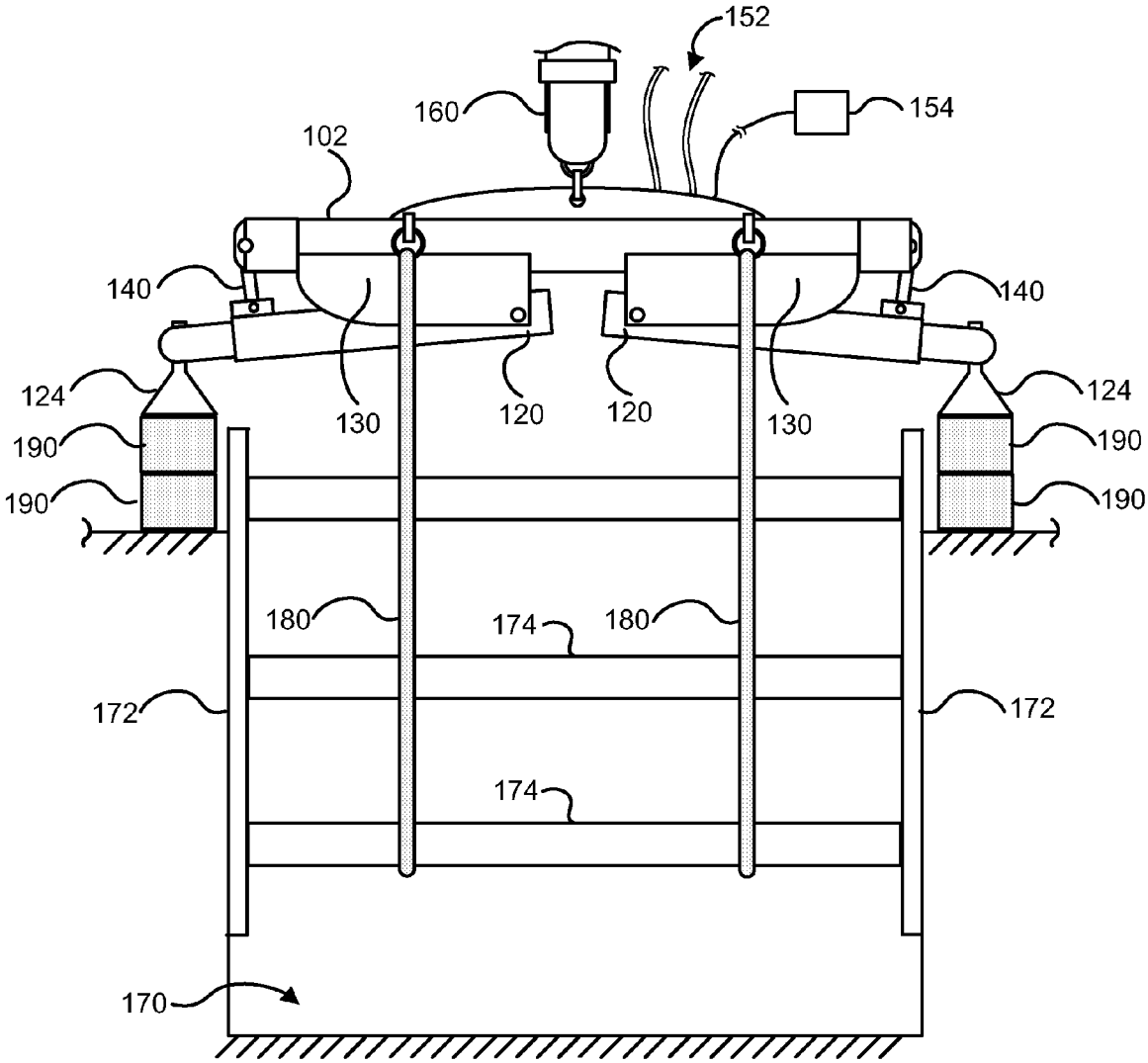
Figure 10E:
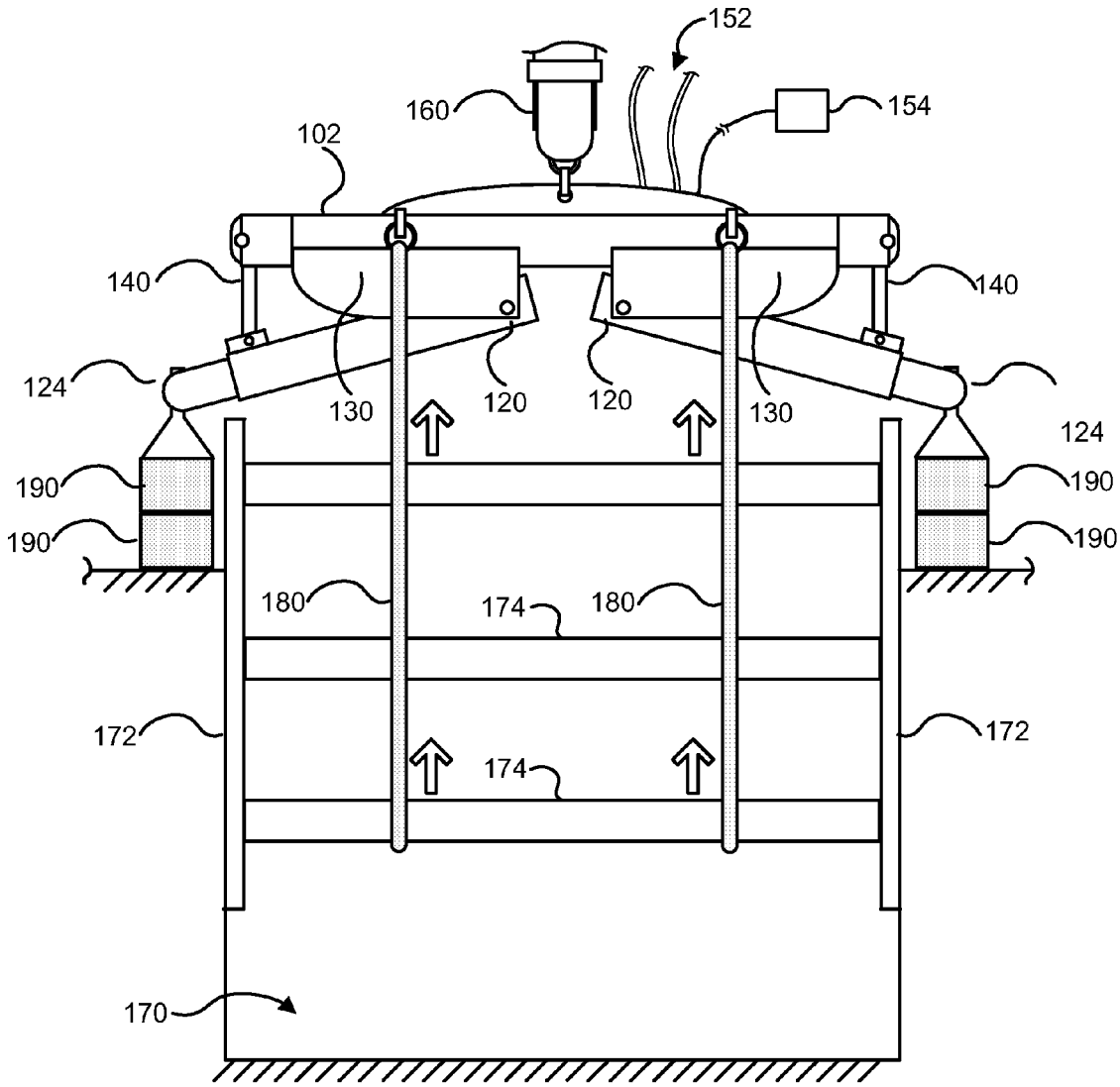

When a maximum height of the device is reached, the cylinders 140 are actuated in a second direction (e.g., fluid removed) to raise the legs 120 while the device is supported by the actuator. One or more spacers 190 may then be placed under each ground pad 124 as shown in FIG. 10B. The jack screws 126 may be used to further adjust the height of ground pad 124 onto the spacer 190 as necessary. With the spacers 190 in place, the cylinders 140 are again actuated to raise the box another increment. As shown in FIGS. 10C-10E, this iterative process may be repeated several times as necessary.

After a number of iterations, the forces on the box from the adjacent earth and the frictional forces are sufficiently reduced so that the device according to the present invention is no longer necessary. This may occur, e.g., when approximately half of the box's height is out of the ground. At this point, the box may be lifted from the trench 170 using the excavator.

Although the invention has been described with reference to a particular arrangement of parts, features and the like, these are not intended to exhaust all possible arrangements or features, and indeed many modifications and variations will be ascertainable to those of skill in the art.

What is claimed is:

1. A hydraulic lifting device, comprising:

a main beam;

two or more connection plates fixedly connected to said main beam;

at least two legs, each leg pivotably attached to two of said plates;

at least two hydraulic cylinders, each cylinder disposed between said beam and one of said legs, wherein said at least two hydraulic cylinders are extendable to raise said main beam; and two or more load connectors.

2. The device according to claim 1, wherein said at least two hydraulic cylinders further maintain said main beam in a substantially horizontal orientation.

3. The device according to claim 1, wherein said at least two hydraulic cylinders operate to pivot said at least two legs.

4. The device according to claim 1, wherein said hydraulic cylinders are connected to said legs outboard of a connection to said side plates.

5. The device according to claim 1, wherein a first one of said hydraulic cylinders is connected to a first distal end of said main beam and a second one of said hydraulic cylinders is connected to a second distal end of said main beam.

6. The device according to claim 1, wherein each of said at least two legs is extendable from a first length to a second length.

7. The device according to claim 6, further comprising:

two or more other hydraulic cylinders for extending said two legs.

8. The device according to claim 1, further comprising:

two or more load slings removably connectable to the two or more load connectors.

9. The device according to claim 1, wherein each of said legs comprises a ground pad connectable at a distal end of said leg.

10. The device according to claim 1, further comprising:

at least one hydraulic fluid connection; and a control unit for controlling said at least two hydraulic cylinders.

11. The device according to claim 1, wherein said beam includes a suspension connection for supporting the device.

12. The device according to claim 11, wherein said suspension connection is adaptable to connect to an excavator.

13. A device for trench shoring extraction, comprising:

a main beam;

at least two legs pivotably connectable to said beam, each of said legs having a ground pad at its distal end;

at least two hydraulic cylinders, each cylinder disposed between said beam and one of the at least two legs;

two or more load connectors mounted to said beam; and wherein said at least two cylinders operate to pivot said at least two legs and raise said main beam.

14. The device according to claim 13, wherein at least one of said main beam and said legs is extendable in length.

15. The device according to claim 13, wherein each of said legs includes an intermediate link pivotably connected on one end to said main beam and on the other end to said leg.

16. The device according to claim 13, wherein each of said at least two legs comprises an extendable portion at its distal end.

17. The device according to claim 13, further comprising:

at least one hydraulic fluid connection for providing fluid to and returning fluid from said at least two hydraulic cylinders.

18. The device according to claim 13, further comprising:

a control unit for controlling said at least two hydraulic cylinders.

19. The device according to claim 18, wherein said a control unit further controls extendable portions of said at least two legs.

20. A method for extracting trench shoring, comprising the steps of:

providing a hydraulic lifting device comprising a main beam, at least two legs pivotably connectable to the beam wherein each of the legs includes a ground pad at its distal end, at least two hydraulic cylinders, each cylinder disposed between the main beam and one of the at least two legs and wherein the cylinders operate to pivot the at least two legs, and one or more slings connectable to the main beam;

extending at least one of the legs until the ground pads span a trench;

lowering said hydraulic lifting device over an opening of the trench until said hydraulic lifting device is at least partially supported over the trench by the ground pads;

connecting the one or more slings about at least one trench shoring element; and actuating the hydraulic cylinders in a first direction to raise said main beam and lift the trench shoring element a first distance.

21. The method according to claim 20, wherein the hydraulic lifting device includes connection plates fixed to the main beam, wherein the legs of the hydraulic lifting device are connectable to the beam via the connection plates.

22. The method according to claim 20, further comprising the steps of:

actuating the hydraulic cylinders in a second direction to raise the at least two legs;

positioning at least one spacer under each ground pad; and actuating the hydraulic cylinders in the first direction to lift the trench shoring element a second distance.

23. The method according to claim 20, wherein each of the ground pads includes an adjustable jack screw; and wherein said step of positioning the at least spacer includes adjusting the jack screw.

24. The method according to claim 20, further comprising the step of:

providing a second one of the hydraulic lifting devices; and connecting one or more slings of the second device about a second portion of the trench shoring element.

25. The method according to claim 20, wherein said step of actuating at least one of the hydraulic cylinders includes actuating the hydraulic cylinders at least one of simultaneously and consecutively to elevate the main beam in a substantially horizontal orientation.

* * * * *